US005673027A

United States Patent [19]

Morita

[11] Patent Number: 5,673,027

[45] Date of Patent: Sep. 30, 1997

[54] SMOKE DETECTOR, ADJUSTMENT APPARATUS AND TEST APPARATUS FOR SUCH A SMOKE DETECTOR

[75] Inventor: Toshikazu Morita, Tokyo, Japan

[73] Assignee: Nohmi Bosai Ltd., Tokyo, Japan

[21] Appl. No.: 357,181

[22] Filed: Dec. 13, 1994

[30] Foreign Application Priority Data

Dec. 16, 1993 [JP] Japan ..... 5-316596

[51] Int. Cl.[6] ..... G08B 17/10

[52] U.S. Cl. ..... 340/630; 340/501; 340/628; 250/574

[58] Field of Search ..... 340/630, 628, 340/629, 501; 250/574; 356/438

[56] References Cited

U.S. PATENT DOCUMENTS

| | | | |
|---|---|---|---|
| 4,317,113 | 2/1982 | Honma | 356/438 |
| 4,321,466 | 3/1982 | Mallory et al. | 340/630 |
| 4,408,880 | 10/1983 | Tsuji et al. | 250/574 |
| 4,647,785 | 3/1987 | Morita | 250/574 |
| 4,647,786 | 3/1987 | Güttinger et al. | 250/574 |
| 4,785,283 | 11/1988 | Yuchi | 340/501 |
| 4,823,015 | 4/1989 | Galvin et al. | 340/630 |

FOREIGN PATENT DOCUMENTS

| | | | |
|---|---|---|---|
| 0011364 | 5/1980 | European Pat. Off. | G08B 17/102 |
| 0122489 | 10/1984 | European Pat. Off. | G08B 17/107 |
| 2188725 | 10/1987 | United Kingdom | G08B 17/103 |

OTHER PUBLICATIONS

Patent Abstracts of Japan, vol. 9, No. 79 (P-347) (1802) 9 Apr. 1985.

*Primary Examiner*—Brent A. Swarthout
*Assistant Examiner*—Van T. Trieu
*Attorney, Agent, or Firm*—Wenderoth, Lind & Ponack

[57] ABSTRACT

An inexpensive smoke detector having excellent general versatility and reliability allows for an increase in a range of selecting light emitting devices used for such smoke detectors and allows for reductions in the number of processes and adjustment equipment, thereby reducing costs and avoiding human adjustment errors. The smoke detector includes an A/D conversion circuit for measuring an output from a photo transistor which receives a light output of at least a light emitting diode used for smoke detection. A MPU generates a signal for driving the light emitting diode, based on a value measured by the A/D conversion circuit. The smoke detector also includes an EEPROM. A D/A conversion circuit adjusts a light emission quantity of the light emitting diode based on a value read from the EEPROM. The smoke detector further includes a voltage/current conversion circuit.

28 Claims, 11 Drawing Sheets

CONVERTED A/D VALUE-VS.-SMOKE DENSITY CONVERSION TABLE

CONVERTED A/D VALUE-VS.-ANALOG SIGNAL CONVERSION TABLE

SMOKE DETECTOR, ADJUSTMENT APPARATUS AND TEST APPARATUS FOR SUCH A SMOKE DETECTOR

BACKGROUND OF THE INVENTION

1. Field of the Invention

The present invention relates to a smoke detector for detecting smoke generated by a fire, and an adjustment apparatus and a test apparatus for such a smoke detector. More particularly, the invention relates to a photoelectric-type smoke detector based on the principle of light scattering or light obscuration caused by smoke particles, and also relates to an adjustment apparatus and a test apparatus for such a smoke detector.

2. Description of the Related Art

Generally, in the manufacturing process of smoke detectors, the sensitivity of the smoke detector varies depending on variations in the individual parts of the smoke detector. It is thus necessary to adjust the smoke detector to reach correct sensitivity.

The variations in the parts of a photoelectric-type smoke detector, which variations have an adverse influence on sensitivity, largely include a variation in light emission quantity due to a variation in luminous efficiency of a light emitting device, a variation in light receiving quantity due to a variation in the light receiving efficiency of a light receiving device, a variation in amplification degree of an amplifying circuit, and other variations.

Conventionally, the following sensitivity adjustment methods are available by way of example for correcting the level of sensitivity due to the foregoing variations. Test smoke is applied to the smoke detector, or alternatively, a test instrument exhibiting an effect similar to smoke is inserted into the detection section of the smoke detector, and the amplification degree or other factors of an amplifying circuit are adjusted using a variable resistor, or the like, so that a light receiving output obtained after being amplified when the test instrument is in the detection section becomes a correct value. Alternatively, adjustments are made, using a variable resistor, or the like, for a fire determining threshold of a fire determining circuit used for determining whether an output from the amplifying circuit has reached such a threshold.

Conventional smoke detectors perform sensitivity adjustments as described above. However, there is a limit to the range of the sensitivity adjustments performed by a variable resistor, or the like, and, for further fine adjustments, it is necessary to limit the adjustment range even more. Accordingly, this may result in an adjustment incapability depending on the conditions, for example, if a variation in the light emission quantity of the light emitting device exceeds a predetermined limit.

In order to cope with such problems, conventionally, light emitting devices used for fire detectors are screened, but such screening presents problems in that there is a decrease in the yield, thereby accordingly increasing the cost.

Also, sensitivity adjustment by a variable resistor, or the like, is performed manually or by using a robot, or the like, thus increasing the number of processes and the equipment investment costs.

Further, as a method for checking the function of a smoke detector where it is installed, a method for driving a test circuit contained in the fire detector in response to a remote command from a fire receiver or the like has been put into practical use. However, the foregoing problems also apply to adjustments for a testing light emitting device used for the test circuit as pseudo smoke and to a correction for the light quantity of the device.

SUMMARY OF THE INVENTION

Accordingly, in order to overcome the above drawbacks, an object of the present invention is to provide an inexpensive smoke detector having excellent general versatility and reliability which allows an increase in a range of screening light emitting devices used for such a detector and which also allows a reduction in the number of processes and adjustment equipment, thereby reducing cost and avoiding human adjustment errors.

In order to achieve the above objects, according to a first aspect of the present invention, there is provided a smoke detector including light emitting means having at least a light emitting device used for a smoke detection and light receiving means for receiving a light output from the light emitting device, the smoke detector comprising: measurement means for measuring an output from the light receiving means; signal generating means for generating a signal for driving the light emitting device, based on a value measured by the measurement means; and adjustment means for adjusting a light emission quantity of the light emitting device based on an output from the signal generating means. According to this construction, an automatic adjustment can be made for the smoke detection light emitting device, thereby improving the yield and allowing reductions in the number of manufacturing processes and the equipment investment costs, and also avoiding human adjustment errors.

According to a second aspect of the present invention, there is provided a smoke detector including: light emitting means having light emitting devices used for a smoke detection and testing; and light receiving means for selectively receiving a light output from each of the light emitting devices, the smoke detector comprising: measurement means for selectively measuring an output of each of the light emitting devices provided for the light receiving means; signal generating means for generating a signal for driving each of the light emitting devices, based on a value measured by the measurement means, the value corresponding to each of the light emitting devices; and adjustment means for adjusting a light emission quantity of each of the light emitting devices based on an output from the signal generating means. According to this construction, an automatic adjustment can be made for each of the light emitting devices used for a smoke detection and testing, thereby improving the yield and allowing reductions in the number of manufacturing processes and the equipment investment costs, and also avoiding human adjustment errors.

According to a third aspect of the present invention, there is provided a smoke detector in which the measurement means may comprise an A/D conversion circuit for converting the output from the receiving means from an analog signal to a digital signal. According to this construction, the light receiving output can be digitized, thereby simplifying adjustments for the light emission quantities of the light emitting diodes whose precision can thus be enhanced.

According to a fourth aspect of the present invention, there is provided a smoke detector in which the signal generating means may comprise: calculation means for processing the value measured by the measurement means through calculation; and storage means for storing a value obtained by the processing of the calculation means. According to this construction, adjustments for the light emission quantities of the light emitting devices are simplified so that the precision of the devices can be enhanced, and also such storage information can be used as required.

According to a fifth aspect of the present invention, there is provided a smoke detector in which the storage means may be electrically erasable and programmable non-volatile storage means. According to this construction, information required for adjustments can be guaranteed even in case of an emergency, such as a power supply breakdown, thereby improving reliability.

According to a sixth aspect of the present invention, there is provided a smoke detector which may comprise standard light emission value setting means for determining at an initializing stage whether a light emitting device drive signal has been stored in the storage means and setting a standard light emission value in the storage means as a drive signal when a drive signal has not been stored in the storage means. According to this construction, the content of the standard light emission value, or the like, stored in the storage means can be protected from being erroneously erased, which might be caused by, for example, a repair operation after a fire, thereby improving the reliability.

According to a seventh aspect of the present invention, there is provided a smoke detector in which the adjustment means may comprise: a D/A conversion circuit for converting the output from the signal generating means from a digital signal into a voltage signal; and a voltage/current conversion circuit for converting the voltage signal from the D/A conversion circuit into a light emitting current of the light emitting device. According to this construction, adjustments for the light emission quantity of the light emitting diodes can be performed simply and reliably.

According to an eighth aspect of the present invention, there is provided an adjustment apparatus for adjusting a smoke detector, comprising: instruction means for instructing at least a light emitting device used for a smoke detection of the smoke detector to emit light; adjustment-related information generating means for generating an adjustment command and information required for adjusting the smoke detector; and transmitting/receiving means for transmitting the adjustment command and the information generated from the generating means to the smoke detector and receiving a return signal from the smoke detector. According to this construction, an automatic adjustment can be made for the smoke detection light emitting device of the smoke detector, thereby contributing to improvements in general versatility, cost reduction and reliability.

According to a ninth aspect of the present invention, there is provided a smoke detector including light emitting means having at least a light emitting device used for testing and light receiving means for receiving a light output from the light emitting device, the smoke detector comprising: measurement means for measuring an output from the light receiving means; signal generating means for generating a signal for driving the light emitting device, based on a value measured by the measurement means; and adjustment means for adjusting a light emission quantity of the light emitting device based on an output from the signal generating means. According to this construction, an automatic adjustment can be made for the light emission quantity of the testing light emitting device, thereby improving the yield and allowing reductions in the number of manufacturing processes and the equipment investment costs, and also avoiding human adjustment errors.

According to a tenth aspect of the present invention, there is provided a smoke detector in which the measurement means may comprise an A/D conversion circuit for converting the output from the light receiving means from an analog signal to a digital signal. According to this construction, the light receiving output can be digitized, thereby simplifying adjustments for the light emission quantity of the light emitting device whose precision is thus improved.

According to an eleventh aspect of the present invention, there is provided a smoke detector in which the signal generating means may comprise: calculation means for processing the value measured by the measurement means through calculation; and storage means for storing a value obtained by the processing of the calculation means. According to this construction, adjustments for the light emission quantity of the light emitting device can be simplified so that the precision of the device can be improved, and also such storage information can be used as required.

According to a twelfth aspect of the present invention, there is provided a smoke detector in which the storage means may be electrically erasable and programmable non-volatile storage means. According to this construction, information required for adjustments can be guaranteed even in case of an emergency, such as power supply breaking, thereby improving reliability.

According to a thirteenth aspect of the present invention, there is provided a smoke detector which may further comprise standard light emission value setting means for determining at an initializing stage whether a drive signal for driving the testing light emitting device has been stored in the storage means and setting a standard light emission value in the storage means as a drive signal when a drive signal has not been stored in the storage means. According to this construction, the content of the standard light emission value, or the like, stored in the storage means can be protected from being erroneously erased, which might be caused by, for example, a repair operation after a fire, thereby improving the reliability.

According to a fourteenth aspect of the present invention, there is provided a smoke detector in which the adjustment means may comprise: a D/A conversion circuit for converting the output from the signal generating means from a digital signal to a voltage signal; and a voltage/current conversion circuit for converting the voltage signal from the D/A conversion circuit to a light emission current of the light emitting device. According to this construction, adjustments for the light emission quantity of the light emitting device can be performed simply and reliably.

According to a fifteenth aspect of the present invention, there is provided a test apparatus for testing a smoke detector, comprising: instruction means for instructing at least a testing light emitting device of the smoke detector to emit light; testing-related information generating means for generating a test command and information required for testing on the smoke detector; and transmitting/receiving means for transmitting the test command and the information generated from the generating means to the smoke detector and receiving a return signal from the smoke detector. According to this construction, automatic adjustments can be made for the testing detection light emitting device of the smoke detector, thereby contributing to improvements in general versatility, cost reduction and reliability.

DESCRIPTION OF THE PREFERRED EMBODIMENTS

One embodiment of the present invention with the application of, for example, an analog light scattering-type smoke detector, will now be described with reference to the drawings.

Figure 1:
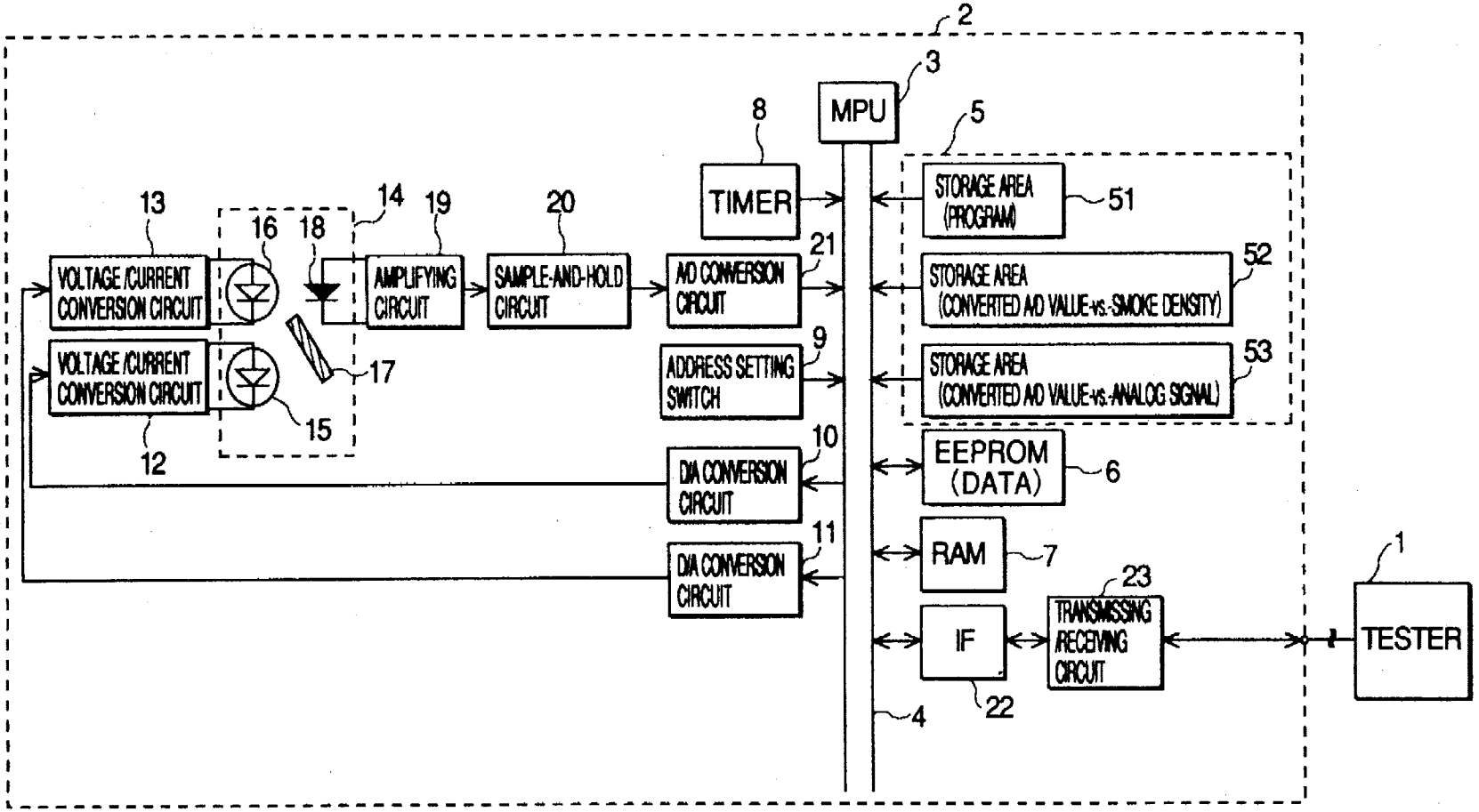
FIG. 1 is a schematic view illustrative of one embodiment of a fire detector according to the present invention.

FIG. 1 is a schematic view of one embodiment of the present invention.

Referring to FIG. 1, connected to a tester 1 used as an adjustment apparatus or a test apparatus is a smoke detector 2 for adjusting the sensitivity of the detector, for example, adjusting the amount of light emitted from a light emitting device.

The smoke detector 2 comprises: a micro processor unit (hereinafter referred to as "the MPU") 3 used as calculation means for executing below-mentioned various types of calculation processing, and the like; a bus 4 including a data bus and a control bus connected to the MPU 3; and a read only memory (hereinafter referred to as "the ROM") 5 connected to the MPU 3 via the bus 4. The ROM 5 further comprises: a storage area 51 which has stored therein below-mentioned programs associated with flow charts of FIGS. 7–9 and various constants, such as a standard light emission value of diodes; a storage area 52 which has stored therein a converted A/D value-versus-smoke density conversion table as a contrast table shown in FIG. 3 indicating characteristics of converted A/D value-vs.-smoke density exhibited by a standard detector; and a storage area 53 which has stored therein a converted A/D value-vs. analog signal conversion table shown in FIG. 4 as a contrast table.

Figure 3:
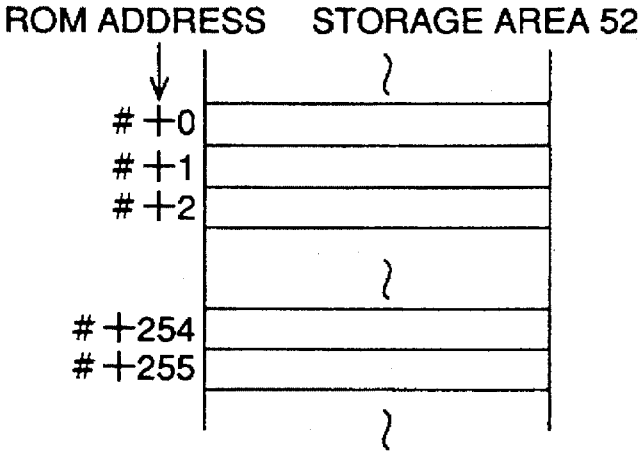
FIG. 3 illustrates a converted A/D value-versus-smoke density conversion table stored in a ROM shown in FIG. 1.
Figure 4:
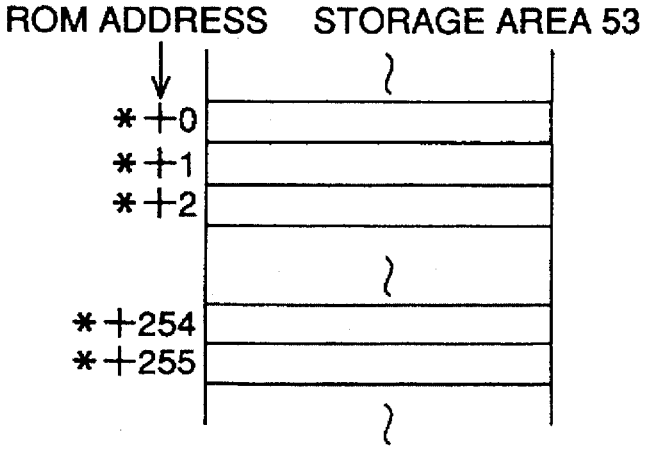
FIG. 4 illustrates a converted A/D value-versus-analog signal conversion table stored in the ROM shown in FIG. 1.

The conversion from the converted A/D value to the smoke density illustrated in FIG. 3 is performed as follows. A value obtained by adding a converted A/D value to a leading ROM address # stored in the conversion table is determined as a ROM address. A value stored in such a ROM address is determined as smoke density corresponding to the converted A/D value. Similarly, the conversion from the converted A/D value to the analog signal value illustrated in FIG. 4 is performed as follows. A value obtained by adding a converted A/D value to a leading ROM address * stored in the conversion table is determined as a ROM address. A value stored in such a ROM address is determined as an analog signal value corresponding to the converted A/D value.

The smoke detector 2 also comprises: an EEPROM 6 which is connected to the MPU 3 via the bus 4 and which is electrically erasable and programmable, that is, rewritable as nonvolatile storage means which has stored therein data, such as light emission values from below-mentioned light emitting devices used for smoke detection and testing; a random access memory (hereinafter referred to as "the RAM") 7 which is connected to the MPU 3 via the bus 4 and which is used as a work area for which the MPU 3 executes calculation processing, or the like; a timer 8 connected to the MPU 3 via the bus 4; and an address setting switch 9 as self-address storage means which is connected to the MPU 3 via the bus 4 and which is formed of, for example, a DIP (dual in-line switch). In place of the address setting switch 9, an EPROM, an EEPROM, a RAM equipped with a backup power, or the like, may be used as self-address storage means.

The smoke detector 2 further comprises: D/A conversion circuits 10 and 11 which are connected to the MPU 3 via the bus 4 and which convert digital signals read from, for example, the storage area 53 of the ROM 5, into analog signals, under the control of the MPU 3; voltage/current conversion circuits 12 and 13 which convert digital signals from the D/A conversion circuits 10 and 11, respectively, from voltage signals into current signals; and a smoke detection chamber 14.

Figure 2:
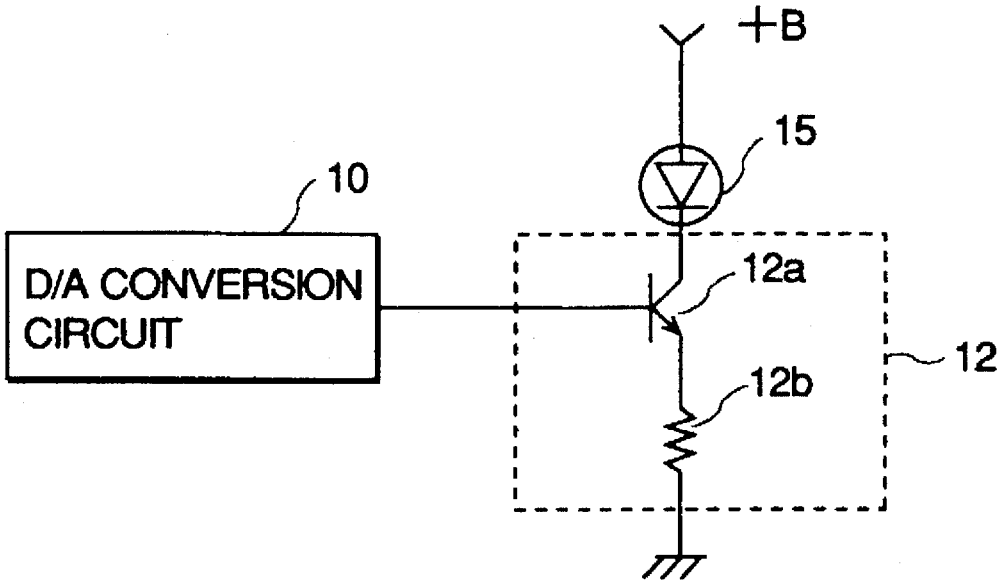
FIG. 2 is a schematic view illustrative of one example of a voltage/current conversion circuit shown in FIG. 1.

The voltage/current conversion circuit 12 is constructed as illustrated in FIG. 2 by way of example. The circuit 12 comprises between a power supply terminal +B and the ground: a light emitting diode 15; and a transistor 12*a* and a resistor 12*b* which are connected in series to each other. An output from the D/A conversion circuit 10 is adapted to be supplied to the base of the transistor 12*a*. The voltage/current conversion circuit 13 is constructed in a manner similar to the voltage/current conversion circuit 12, though it is not shown.

The smoke detection chamber 14 comprises therein the following components. Light emitting diodes 15 and 16 (hereinafter referred to as "the LEDs"), for example, are connected to the output terminals of the voltage/current conversion circuits 12 and 13, respectively, so as to be used as a smoke detection light emitting device and a testing light emitting device, respectively, driven by the output from the respective voltage/current conversion circuits 12 and 13. A photo transistor 18 is placed to receive via a light-screen portion 17 scattering light caused by smoke through a light output from the smoke detection light emitting diode 15 and to directly receive a light output from the testing light emitting diode 16 so that it serves the function of a light receiving device by way of example.

The light emitting diode 15 is adapted to be driven by the voltage/current conversion circuit 12 so that it is able to emit light intermittently, for example, every 2.5 to 3 seconds, for a duration required for the photo transistor 18 to receive scattering light caused by a light output from the light emitting diode 15. On the other hand, the light emitting diode 16 is adapted to be driven by the voltage/current conversion circuit 13 so that it is able to supply light, similar to the scattering light caused by smoke, to the photo diode 18 through light emission.

The smoke detector 2 still further comprises: an amplifying circuit 19 for amplifying an output from the photo transistor 18; a sample-and-hold circuit 20 for sampling and holding the output from the amplifying circuit 19; an A/D conversion circuit 21 which is connected at the output terminal to the MPU 3 via the bus 4 and which is used as measurement means for converting the output from the sample-and-hold circuit 20 from an analog signal to a digital signal; an interface 22 (hereinafter referred to as "the IF") connected to the MPU 3 via the bus 4; and a transmitting/receiving circuit system 23 which is connected between the IF 22 and the tester 1 and comprises a receiving circuit, a serial-to-parallel conversion circuit, a parallel-to-serial conversion circuit, a transmitting circuit, and the like, though such circuits are not shown. When the transmitting/receiving circuit system 23 is connected to a receiving section (not shown) of a fire receiver, or the like, it transmits and receives information with such a receiving section.

The RAM 7 sets a testing start flag when testing has started, and resets the testing start flag at other times, that is, when sensitivity adjustments are performed. Both light emitting diodes 15 and 16 are permitted to emit light when the testing start flag is set, while only the light emitting diode 15 is permitted to emit light when the testing start flag is reset. Moreover, the RAM 7 sets a testing data flag, which indicates that the smoke density and an analog signal value to be stored in the RAM 7 are merely testing data when the testing start flag is set, while the RAM 7 resets the testing data flag when the testing start flag is reset.

The MPU 3 and the EEPROM 6 constitute signal generating means. The D/A conversion circuit 10 and the voltage/current conversion circuit 12 constitute adjustment means. The light emitting diodes 15 and 16 and the light-screen portion 17 form light emitting means. The photo transistor 18, the amplifying circuit 19 and the sample-and-hold circuit 20 form light receiving means.

Figure 5:
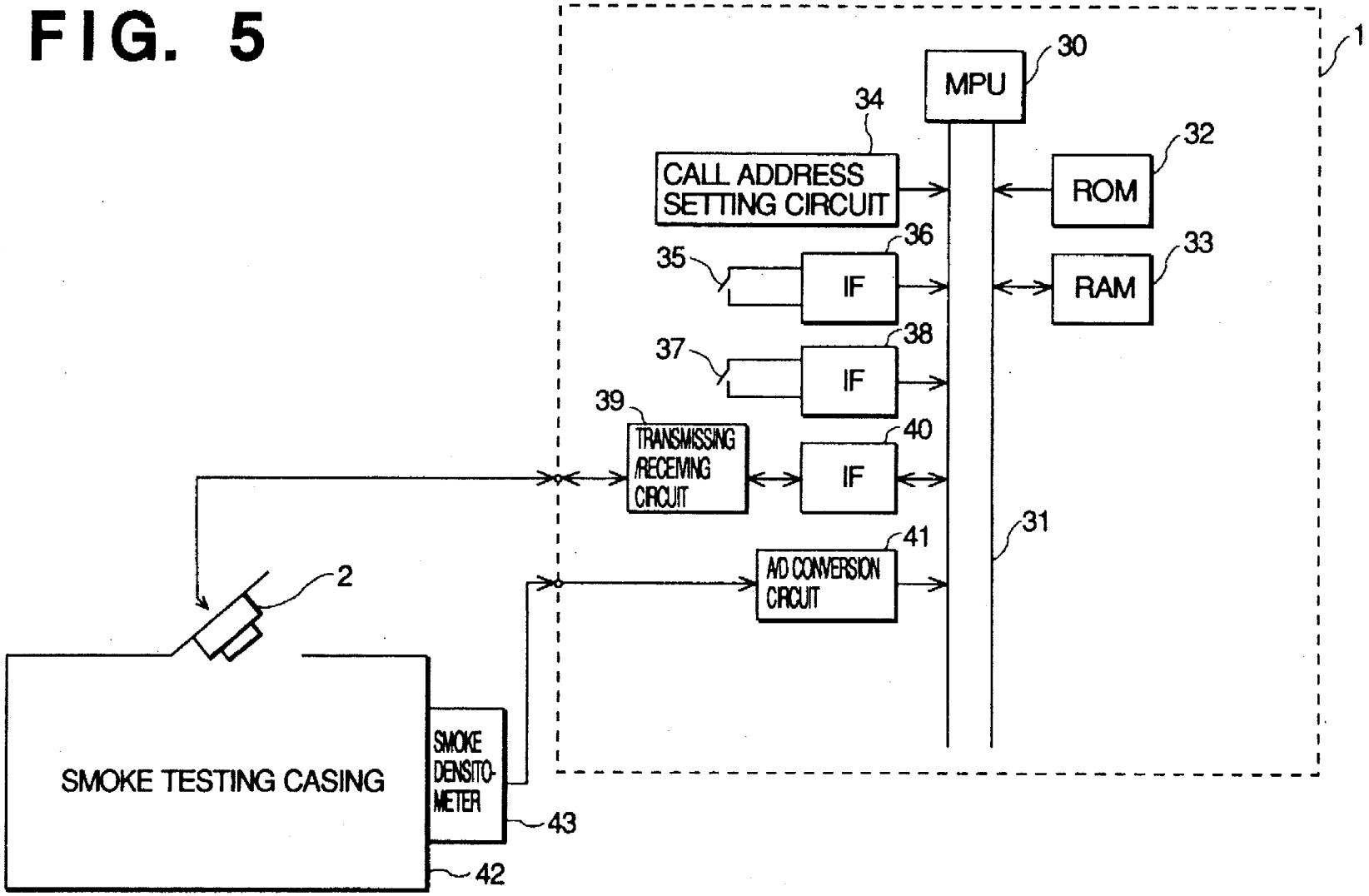
FIG. 5 is a schematic view illustrative of one embodiment of an adjustment apparatus for the fire detector according to the present invention.

FIG. 5 is a schematic view illustrative of the construction of the tester 1 used as an adjustment apparatus or a testing apparatus by way of example and also illustrative of the connecting state of the smoke detector 2 with the tester 1 so as to perform sensitivity adjustments.

Referring to FIG. 5, the tester 1 comprises: a MPU 30 used as calculation means for executing below-mentioned various types of calculation processing; a bus 31 including a data bus and a control bus connected to the MPU 30; a ROM 32 which is connected to the MPU 30 via the bus 31 and which is used as storage means that has stored therein programs associated with a below-mentioned flow chart of FIG. 6 and various constants; a RAM 33 which is connected to the MPU 30 via the bus 31 so as to be used as a work area for which the MPU 30 executes calculation processing, or the like; a call address setting circuit 34 which is connected to the MPU 30 via the bus 31 and which is formed of, for example, a ten key; a sensitivity adjustment command switch 35 connected to the MPU 30 via an IF 36 and the bus 31, that is, a switch which is turned ON when adjustments are made for the light quantity of the smoke detection light emitting diode 15; a testing adjustment command switch 37 connected to the MPU 30 via an IF 38 and the bus 31, that is, a switch which is turned ON when adjustments are made for the light quantity of the testing light emitting diode 16; a transmitting/receiving circuit system 39 which is connected to the MPU 30 via an IF 40 and the bus 31 and which comprises a receiving circuit, a serial-to-parallel conversion circuit, a parallel-to-serial conversion circuit and a transmitting circuit, though such circuits are not shown; and an A/D conversion circuit 41 which is connected to the MPU 30 via the bus 31 and which converts an output from a below-mentioned smoke densitometer from an analog signal to a digital signal.

A smoke testing casing 42 is used, for example, for making sensitivity adjustments for the smoke detector 2. The smoke detector 2 is mounted inside the upper portion of the smoke testing casing 42 and accommodated therein. The output terminal of the smoke detector 2, that is, the output terminal of the transmitting/receiving circuit 23 (See FIG. 1), is electrically connected to the input terminal of the transmitting/receiving circuit 39 of the tester 1.

A smoke densitometer 43 for measuring the smoke density within the smoke testing casing 42 is electrically connected at the output terminal to the input terminal of the A/D conversion circuit 41.

As is seen from the foregoing description, the tester 1 is adapted to transmit and receive information with the smoke detector 2 and also to measure the testing smoke density supplied to the smoke detector 2 for sensitivity adjustments.

The call address setting circuit 34 and the switch 35 constitute instruction means. The MPU 30, the RAM 33, the A/D conversion circuit 41, the smoke testing casing 42 and the smoke densitometer 43 form adjustment-related information generating means.

A description will now be given of the operation according to one embodiment of the present invention with reference to FIGS. 6–12.

An explanation will first be given of the sensitivity adjustments (the adjustments for the light quantity of the LED) of the smoke detector 2 by use of the tester 1 with reference to FIGS. 6–8. All the decisions concerning the tester 1 and the smoke detector 2 which will be referred in the following description of the operation are made by the MPU 30 and the MPU 3, respectively. The smoke detector 2 is connected to the tester 1 prior to the sensitivity adjustments of the smoke detector 2. Then, the smoke detector 2 is first put into the smoke testing casing 42 which is filled with testing smoke in order to adjust the light quantity of the smoke detection light emitting diode 15.

Figure 6:
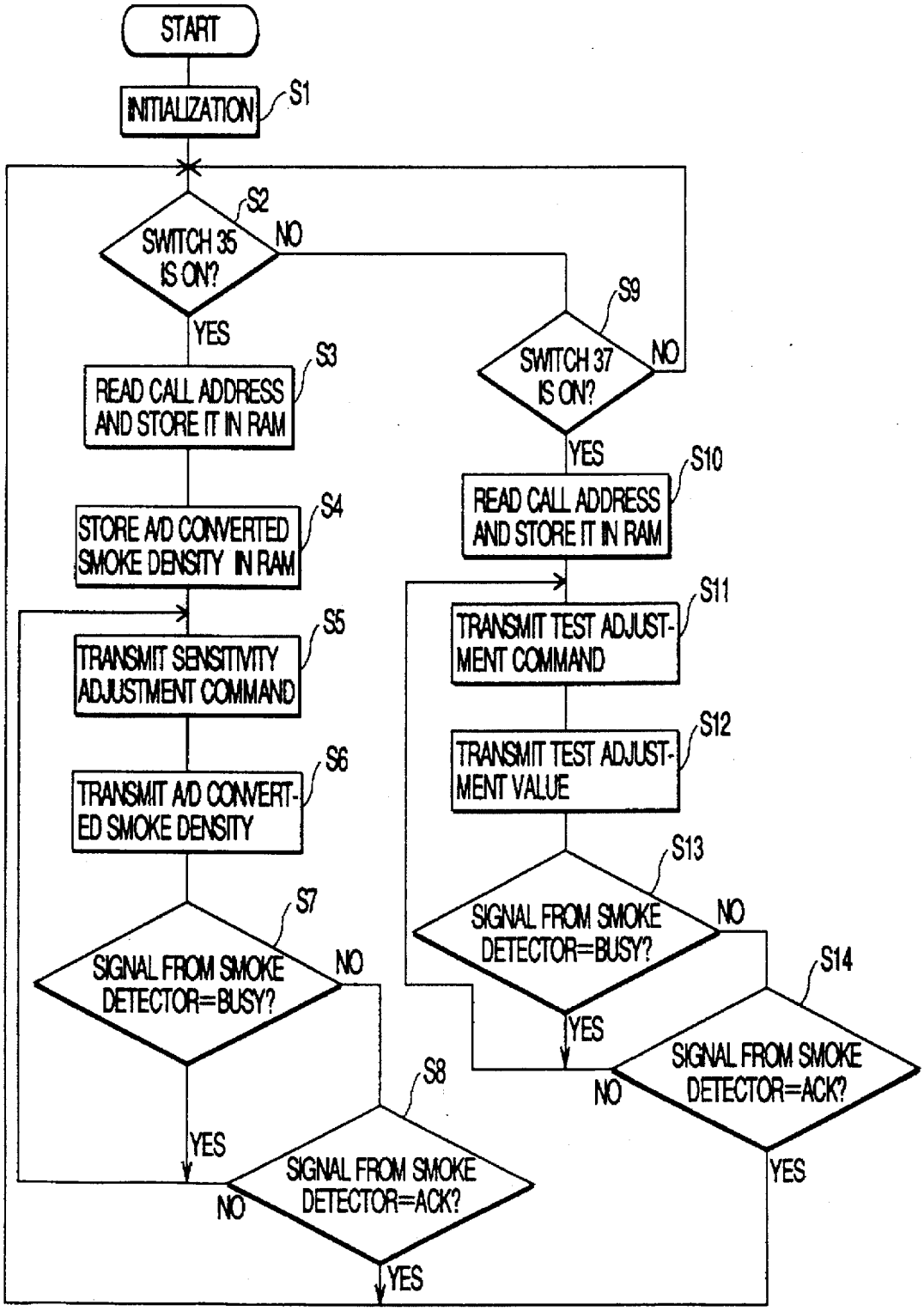
FIG. 6 is a flow chart illustrative of the operation of the adjustment apparatus shown in FIG. 5.

As shown in FIG. 6, in step S1 the tester 1 initializes the RAM 33, the IFs 36, 38, and 40, and the like. In step S2 it is determined whether the switch 35 is ON. In this case, the answer in S2 is YES, and the flow thus proceeds to step S3 in which a call address which has been set by the call address setting circuit 34, that is, a self-address of the smoke detector 2, is read to be stored in a predetermined position of the RAM 33.

Subsequently, in step S4 the testing smoke density within the smoke testing casing 42 is detected by the smoke densitometer 43, and the detected smoke density is A/D converted by the A/D conversion circuit 41 as the set smoke density S so as to be stored in a predetermined position of the RAM 33.

In step S5 a sensitivity adjustment command, that is, a command to adjust the light quantity of the light emitting diode 15, is transmitted, together with the call address, to the smoke detector 2. The flow further proceeds to step S6 in which the converted A/D value, that is, the set smoke density S, is read from the RAM 33 so as to be transmitted to the smoke detector 2.

In response to the transmitted set smoke density S, the smoke detector 2 starts to adjust the light quantity of the light emitting diode 15 which will be mentioned below.

Then, in step S7 the tester 1 identifies a return signal from the smoke detector 2. If such a return signal is a BUSY signal, the flow returns to step S5 in which a sensitivity adjustment command is repeatedly transmitted to the smoke detector 2. In step 8 if it is determined that an ACK command has been returned by the smoke detector 2 after several times of adjustments of the light quantity, it is determined that the smoke density 2 has reached the targeted sensitivity. The flow returns to step S2 and the foregoing procedure is repeated.

During the foregoing adjustments of the light quantity of the light emitting diode 15, the following processing is executed in the smoke detector 2. Such processing will be explained with reference to FIGS. 7 and 8.

In step S21 the RAM 7 is cleared (such as resetting of the testing start flag), and it is determined whether the light emission values of the light emitting diodes 15 and 16 have been stored in the EEPROM 6. If the answer in S21 is NO, the standard light emission values of the respective diodes 15 and 16 are written into the EEPROM 6 as light emission values, and predetermined values are set in the timer 8, such predetermined values being indicative of, for example, how many times the light emitting diodes 15 and 16 are allowed to emit light for a predetermined duration (for example, one time every 3 seconds).

Figure 10:
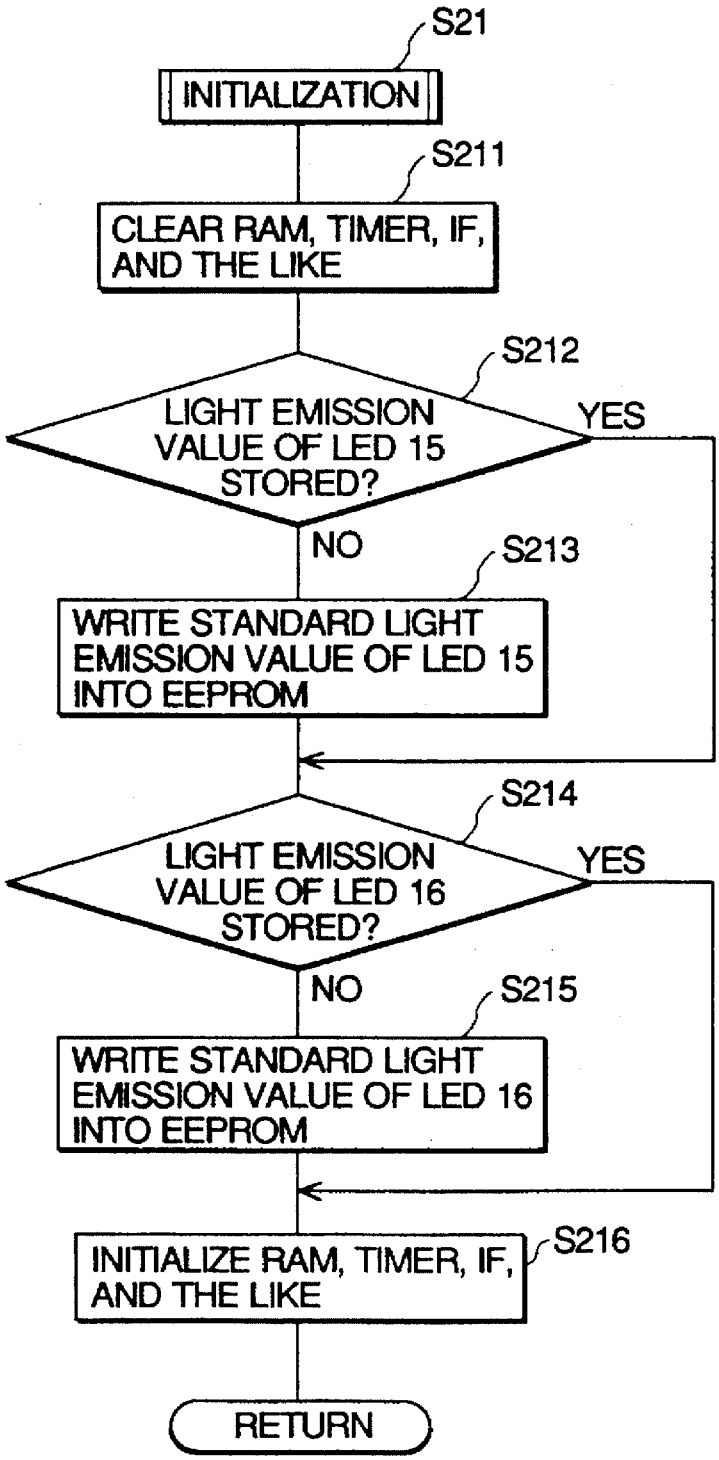
FIG. 10 is a flow chart illustrative of the operation of the fire detector shown in FIG. 1.

More specifically, as shown in FIG. 10, in step S211 the RAM 7, the timer 8, the IF 22, and the like, are cleared, and then, in step S212 it is determined whether the light emission value of the light emitting diode 15 has been stored in the EEPROM 6. If the answer in S212 is NO, the flow proceeds to step S213 in which the standard light emission value of the diode 15 is read from the storage area 51 of the ROM 5 and such a standard value is written into a predetermined position of the EEPROM 6 as a light emission value.

Conversely, if the answer in S212 is YES, the flow proceeds to step S214 in which it is similarly determined whether the light emission value of the diode 16 has been stored in the EEPROM 6. If the answer in S214 is NO, the flow proceeds to step S215 in which the standard light emission value of the diode 16 is read from the storage area 51 of the ROM 5 and such a standard value is written into a predetermined position of the EEPROM 6 as a light emission value.

Subsequently, in step S216 the RAM 7, the timer 8, the IF 22, and the like, are initialized.

Upon completion of the initialization, the flow returns to the flow chart of FIG. 7 again. In step S22 it is determined whether the timer 8 has reached a predetermined value indicative of the light emission timing. If the answer in S22 is YES, the flow proceeds to step S23 in which it is determined whether the testing start flag has been set in the RAM 7. In this case, since the testing start flag has been reset, the flow proceeds to step S24 in which the testing data flag of the RAM 7 is reset, and then, the light emission value of the smoke detection diode 15 is read from the EEPROM 6.

Further, in step S25 the light emission value is converted into a voltage signal by the D/A conversion circuit 10 so as to allow the light emitting diode 15 to emit light via the voltage/current conversion circuit 12.

In step S28 an output from the photo transistor 18 which has received the light output from the diode 15 is supplied to the A/D conversion circuit 21 via the amplifying circuit 19 and the sample-and-hold circuit 20, and the converted A/D value is temporarily stored in the RAM 7. Then, in step S29 the converted A/D value is converted into corresponding smoke density K by looking up the converted A/D value-vs.-smoke density conversion table stored in the storage area 52 of the ROM 5, and such smoke density K is updated and stored in a predetermined position of the RAM 7.

Likewise, in step S30 the converted A/D value is converted into an analog signal value A by looking up the converted A/D value-vs.-analog signal conversion table stored in the storage area 53 of the ROM 5, and such a analog signal value A is updated and stored in a predetermined position of the RAM 7.

In short, a series of operations executed in steps S22–S25 and S28–S30 indicate the state in which the smoke detector 2 monitors environmental conditions around the detector 2.

The flow further proceeds to step S31 in which it is determined whether the self address has been called from the receiving section of the tester 1, a fire receiver, or the like. If the answer in S31 is NO, the flow returns to S22 in which the foregoing procedure is repeated. Also, even if the timer 8 has not reached a predetermined value in S22, the flow proceeds to S31 in which it is determined whether the self address has been called.

Subsequently, in step S32 it is determined whether a sensitivity adjustment command has been given from the tester 1. In this case, since such a command has already been given from the tester 1 in step S5 (See FIG. 6), the flow proceeds to step S33 in which the testing start flag of the RAM 7 is reset, and then, it is determined whether the set smoke density S which had previously been transmitted from the tester 1 in step S6 (See FIG. 6) has been received.

In short, the foregoing steps S31–S33 indicate the state in which the smoke detector 2 communicates with the tester 1.

Figure 7:
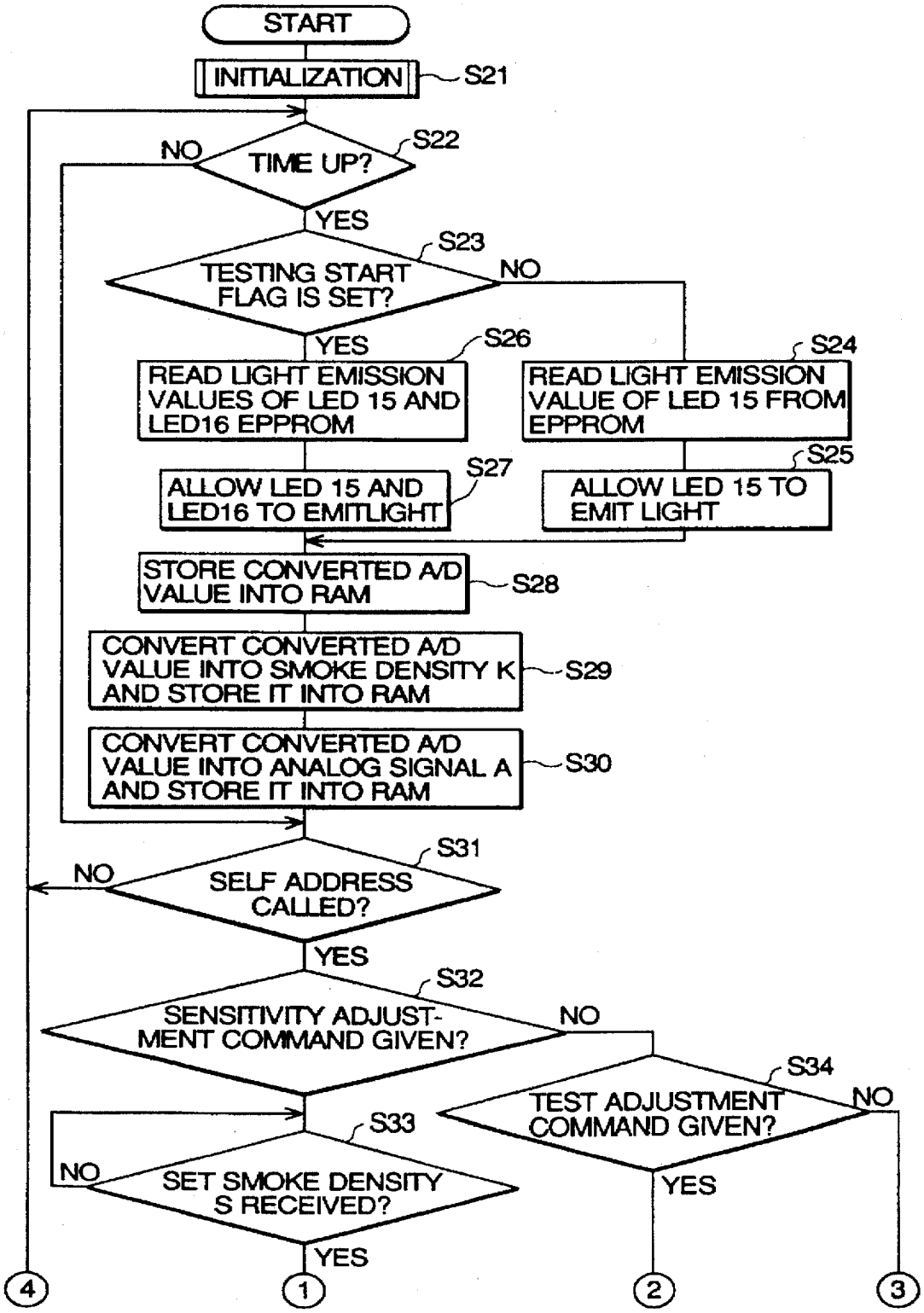
FIG. 7 is a flow chart illustrative of the operation of the fire detector shown in FIG. 1.
Figure 8:
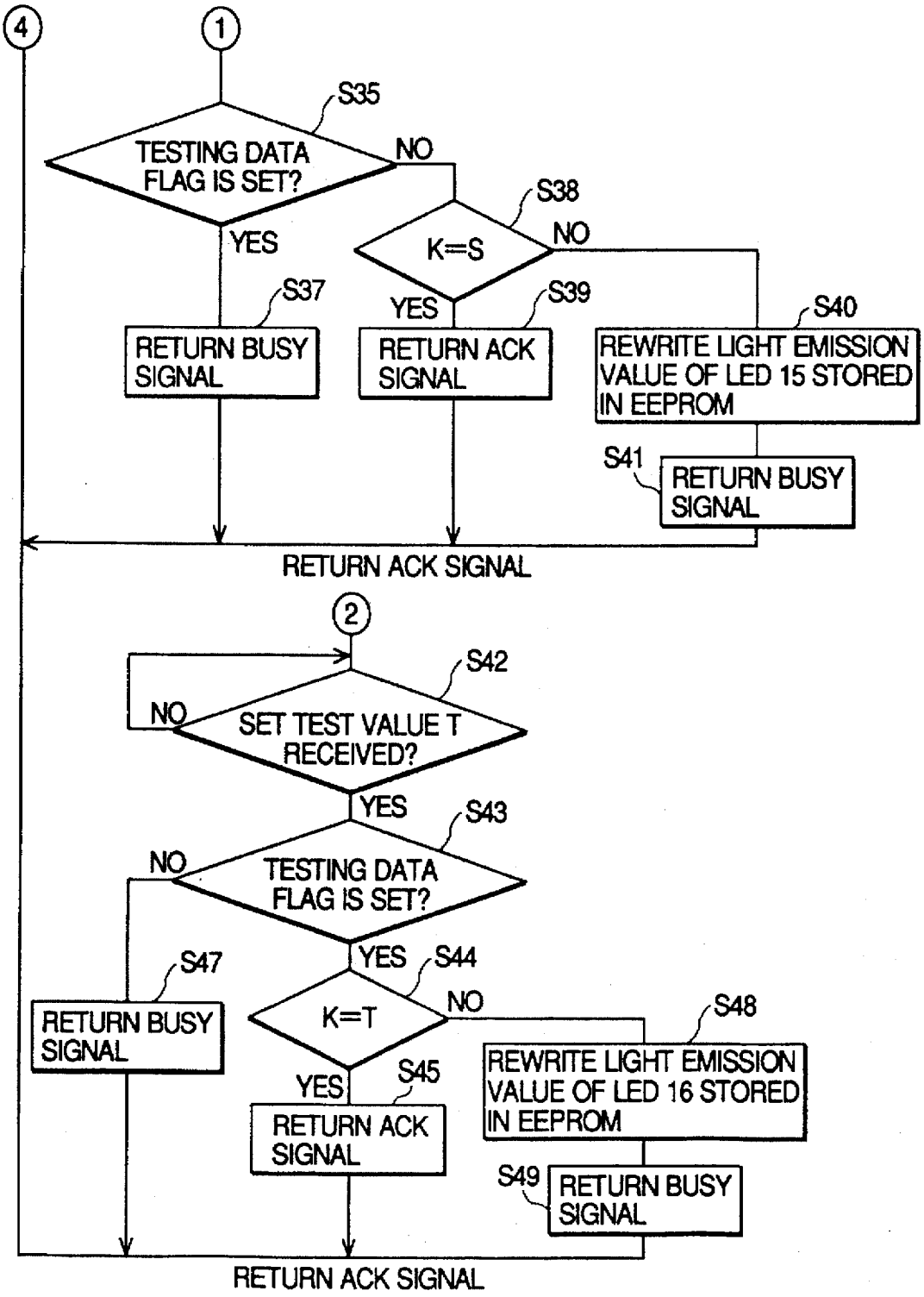
FIG. 8 is a flow chart illustrative of the operation of the fire detector shown in FIG. 1.

When it is determined that the set smoke density S from the tester 1 has been received, the flow proceeds to step S35 of FIG. 8. In step S35 it is determined whether the testing data flag has been set in the RAM 7. In this case, since the testing data flag has been reset, the flow proceeds to step S38 in which a comparison is made between the smoke density K stored in the RAM 7 in step S29 (See FIG. 7) and the set smoke density S received from the tester 1. If the two density values coincide with each other or a disparity thereof is in a permissible range, it is determined that the smoke detector 2 has reached targeted characteristics of the smoke density in relation to the converted A/D value, which characteristics are exhibited by a standard detector. Accordingly, it is determined that the sensitivity adjustments have been completed, and in step S39 an ACK signal indicative of the completion of sensitivity adjustments is returned to the tester 1. If the foregoing two density values do not coincide with each other in step S38, the flow proceeds to step S40 in which the light emission value of the smoke detection diode 15, which value is stored in the EEPROM 6, is rewritten to increase or decrease so that it can coincide with the set smoke density S. Then, in step S41 a BUSY signal indicating that the sensitivity adjustments have not been completed is returned to the tester 1, and the flow returns to step S22 in which the foregoing procedure is repeated.

If the testing data flag has been set in step S35, that is, if the testing flag has been set during the sensitivity adjustments, the converted A/D value must mean the one when testing is under way. In such a case, after a BUSY signal is returned in step S37, the flow returns to step S22 in which a comparison is made again between the set smoke density S and the smoke density corresponding to the converted A/D value obtained when only the light emitting diode 15 has been emitted.

Subsequently, in order to adjust the light quantity of the testing light emitting diode 16, the smoke detector 2 is taken out from the smoke testing casing 42, followed by turning OFF the switch 35 and turning ON the switch 37 of the tester 1.

As illustrated in FIG. 6, if the tester 1 determines that the switch 35 is OFF in step S2, the flow proceeds to step S9 in which the tester 1 determines whether the switch 37 is ON. In this case, the switch 37 is ON for adjusting the light quantity of the diode 16, the flow proceeds to step S10 in which the call address which has been set by the call address setting circuit 34, that is, the self address of the smoke detector 2, is read and stored in a predetermined position of the RAM 33.

Then, in step S11 a test adjustment command, that is, a command to adjust the light quantity of the diode 16, is transmitted, together with the call address, to the smoke detector 2. In step S12 the converted A/D value, which is the set test value T as a test adjustment value, is read from the ROM 32 and transmitted to the smoke detector 2. The set test value T may be set to be an arbitrary value by the adjuster (tester) 1.

In response to the converted A/D value, the smoke detector 2 starts to make the below-mentioned adjustments for the light quantity of the light emitting diode 16.

In step S13 the tester 1 identifies the return signal from the smoke detector 2. If such a return signal is a BUSY signal, the flow returns to step S14 in which a test adjustment command is repeatedly transmitted to the smoke detector 2. If it is determined in step S14 that an ACK command has been returned by the smoke detector 2 after a several times of adjustments of the light quantity, it is determined that the smoke density 2 has reached the targeted sensitivity. The flow returns to step S2 and the foregoing procedure is repeated.

During the foregoing adjustments of the light quantity of the light emitting diode 16, the following processing is executed in the smoke detector 2. Such processing will now be explained with reference to FIGS. 7 and 8 again.

In step S31 it is determined whether the self address has been called. If the answer in S31 is YES, the flow proceeds to step S32 in which it is determined whether a sensitivity adjustment command has been given from the tester 1. In this case, since the testing adjustment command has already been transmitted from the tester 1 in step S11 (See FIG. 6), that is, since the answer in S32 is NO, the flow proceeds to step S34 in which the testing adjustment command is identified and the testing start flag of the RAM 7 is set. In step S42 of FIG. 8, it is determined whether the set test value T which had previously been transmitted from the tester 1 in step S12 (See FIG. 6) has been received.

In short, the foregoing steps S31, S32, S34 and S42 indicate the state in which the smoke detector 2 communicates with the tester 1.

In step S22 it is determined whether the timer 8 has reached a predetermined value. If the answer in S22 is YES, the flow proceeds to step S23 in which it is determined whether the testing start flag has been set in the RAM 7. In this case, since the testing start flag is set, the flow proceeds to step S26 in which the testing data flag is set in the RAM 7, and then, the light emission values of the diodes 15 and 16 are read from the EEPROM 6.

Subsequently, in step S27 the light emission value of the diode 15 is converted to a voltage signal by the D/A conversion circuit 10 so as to allow the diode 15 to emit light via the voltage/current conversion circuit 12. At the same time, the light emission value of the diode 16 is converted into a voltage signal by the D/A conversion circuit 11 so as to allow the diode 16 to emit light via the voltage/current conversion circuit 13.

Then, in step S28 an output from the photo transistor 18 which has received light outputs from the diodes 15 and 16 is supplied to the A/D conversion circuit 21 via the amplifying circuit 19 and the sample-and-hold circuit 20. The resultant converted A/D value is temporarily stored in the RAM 7, and in step S29 it is further converted into corresponding smoke density K by looking up the converted A/D value-vs.-smoke density conversion table stored in the storage area 52 of the ROM 5. A code indicative of test data is further added to the smoke density K, and the resultant density K is stored in a predetermined position of the RAM 7.

Likewise, in step S30 the converted A/D value is converted into a corresponding analog signal A by looking up the converted A/D value-vs.-analog signal conversion table stored in the storage area 53 of the ROM 5. A code indicative of test data is further added to the analog signal A, and the resultant analog signal A is stored in a predetermined position of the RAM 7.

Subsequently, in step S31 it is determined whether the self address has been called. If the answer in S31 is NO, the flow returns to step S22 in which the foregoing procedure is repeated. In S22, even if the timer 8 has not reached a predetermined value, the flow proceeds to step S31 in which it is also determined whether the self address has been called.

When the set test value T is received from the tester 1, the flow proceeds to step S43 of FIG. 8. In step S43 it is determined whether the testing data flag has been set in the RAM 7. In this case, since the answer in S43 is YES, the flow proceeds to step S44 in which a comparison is made between the smoke density K stored in the RAM 7 in step S29 (See FIG. 7) is compared with the set test value T received from the tester 1. If the two values coincide with each other or a disparity thereof is in a permissible range, it is determined that the smoke detector 2 has reached targeted characteristics of the smoke density in relation to the converted A/D value, which characteristics are exhibited by a standard detector. Accordingly, it is determined that the test adjustments have been completed, and in step S45 an ACK signal indicative of the completion of the test adjustments is returned to the tester 1. If the foregoing two values do not coincide with each other in step S44, the flow proceeds to step S48 in which the light emission value of the testing diode 16, which value is stored in the EEPROM 6, is rewritten to increase or decrease so that the smoke density K can coincide with the set test value T. Then, in step S49 a BUSY signal indicating that the test adjustments have not been completed is returned to the tester 1, and the flow returns to step S22 in which the foregoing procedure is repeated.

If the testing data flag has been reset in step S43, that is, if the testing data flag is reset at the time of sensitivity adjustment, the converted A/D value must indicate the one obtained while in the smoke detection state. In such a case, after a BUSY signal is returned in step S47, the flow returns to step S22 in which a comparison is made again between the set test value T and the smoke density corresponding to the converted A/D value obtained when both light emitting diodes 15 and 16 have been emitted.

The light emission values of the diodes 15 and 16 which have thus been adjusted are stored in the EEPROM 6 as non-volatile data, and are used for such as a fire detection and a function test performed by a fire receiver placed in a security room, a fire fighting control room, or other places.

A description will now be given with reference to FIGS. 9–12 of the operations of a fire detection (monitoring the circumstances) and a function test performed by a fire receiver (not shown) when the smoke detector 2 is connected to the fire receiver.

The operation of the fire detection performed by the fire receiver will first be explained based on FIGS. 11 and 12. The fire receiver executes initialization in step S61. In step S62, a predetermined count value Q which determines the timing of transmitting a test command to the smoke detector 2 is set to be 1 in a counter (not shown) within the fire receiver. Then, in step S63 the call address N of the smoke detector 2 is set to be 1, and in step S64 a circumstances return command is transmitted to a smoke detector provided with a call address which has been set to be 1.

On the other hand, the smoke detector 2 executes processing shown in steps S22–S25 and S28–S30 as described above every time a timeout occurs in the timer 8 in step S22 of FIG. 7. If the self address has been called in step S31 and a sensitivity adjustment command has not been given in step S32 nor has a test adjustment command been given in step S34, it is determined whether a test command (a function test command) has been given in step S50 of FIG. 9. In this case, since the answer in S50 is NO, the flow proceeds to step S51 in which it is determined whether a circumstances return command has been given. If the answer in S51 is NO, the flow returns to step S22 in which the foregoing procedure is repeated.

In this case, however, since the circumstances return command has been transmitted from the fire receiver in step S64, a smoke detector which has received the circumstances return command and has the self address set to be 1, for example, the smoke detector 2, executes the following processing. In step S52 the smoke detector 2 resets the testing start flag of the RAM 7, and in step S54 it reads the analog signal A corresponding to the converted A/D value from a predetermined position of the RAM 7 so as to return it to the fire receiver via the transmitting/receiving circuit 23. If the analog signal A is added by a test data code, it should be returned to the fire receiver as it is so that the fire receiver can identify that the analog signal is used for testing. The data returned in response to the circumstances return command may be the smoke density K.

In step S65 the fire receiver receives the analog signal A transmitted from the smoke detector 2, and in step S66 it is determined whether the received analog signal is greater than a predetermined fire threshold F. If the answer in S66 is YES, it is determined that a fire has occurred and the flow proceeds to step S67 in which a fire indication, or the like, is given. If the received analog signal is used for testing, processing contents similar to those shown in the below-mentioned steps S75–S77 of FIG. 12 are executed, though not shown.

After the above-mentioned fire indication has been given, or in step S66 if the analog signal is smaller than a predetermined fire threshold F, that is, a fire has not occurred, in step S68 the call address N is incremented by 1 and the resultant call address for a subsequent fire detector is set.

In step S69 it is determined whether the call address N is the maximum NMAX. If the answer in S69 is NO, the flow returns to step S64 in which the foregoing procedure is repeated. That is, the fire receiver sequentially transmits circumstances return commands to a plurality of fire detectors which are provided with respective different call addresses and are connected to the common line.

If the call address N is the maximum NMAX in step S69, the flow proceeds to step S70 in which a predetermined count value Q of the counter is incremented by 1. Further, in step S71 it is determined whether the count value Q is greater than a test cycle count threshold X. If the answer in S71 is NO, the flow returns to step S63 in which the foregoing procedure is repeated, that is, the processing of the circumstances monitoring in relation to the smoke detectors which exhibit the call address N in a range from 1 to the maximum NMAX is repeated. If the answer in S71 is YES, the operation goes into the function test shown in FIG. 11.

An explanation will now be given based on FIGS. 9 and 12 of the operation of the function test on the smoke detectors performed by the fire receiver.

Figure 12:
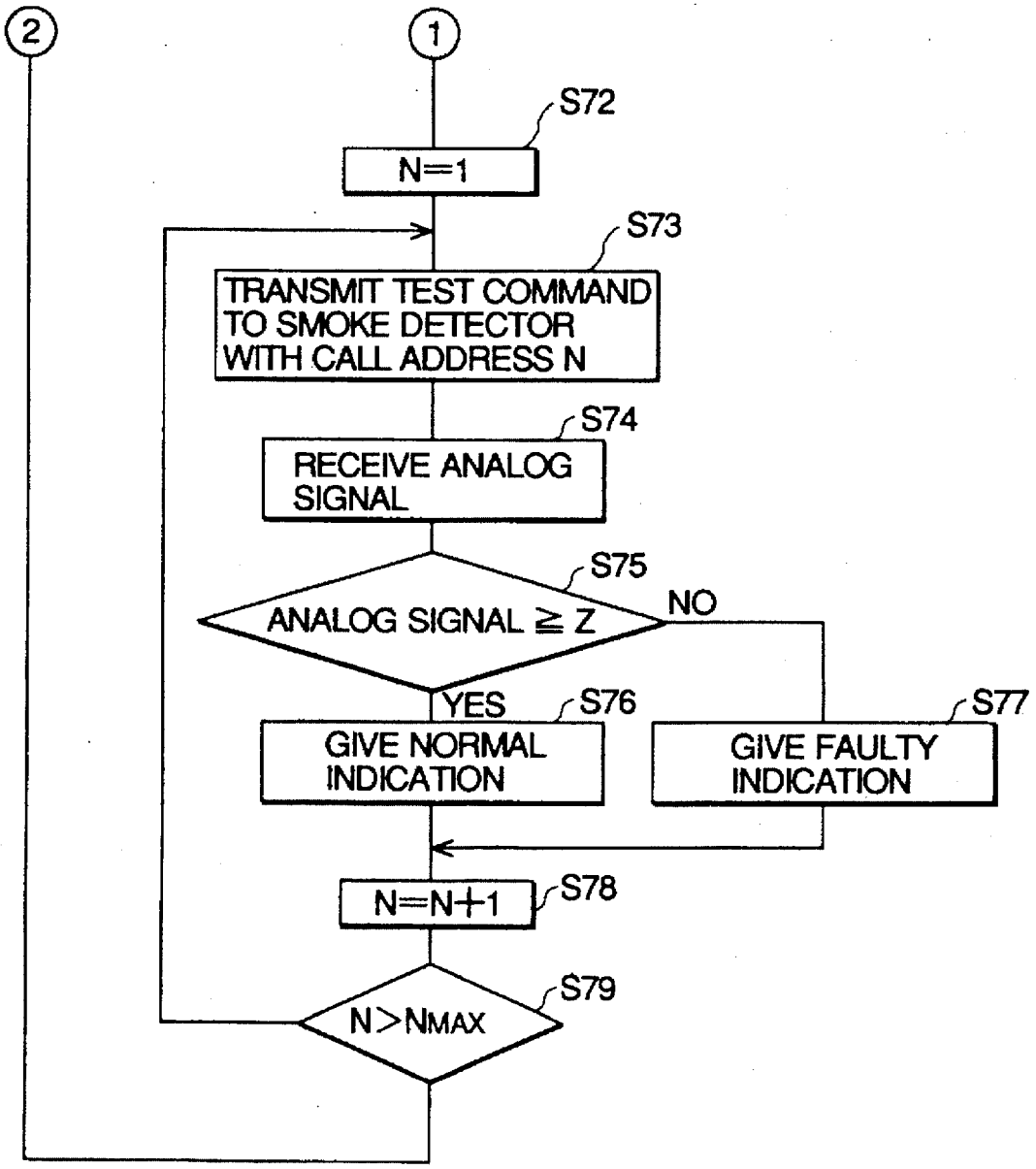
FIG. 12 is a flow chart illustrative of the operation of the fire receiver connected to the fire detector according to the present invention.

In step S72 of FIG. 12, the fire receiver sets the call address N of the fire detector to be 1, and in step S73 the fire receiver transmits a test command to the fire detector which has set the call address to be 1.

Figure 9:
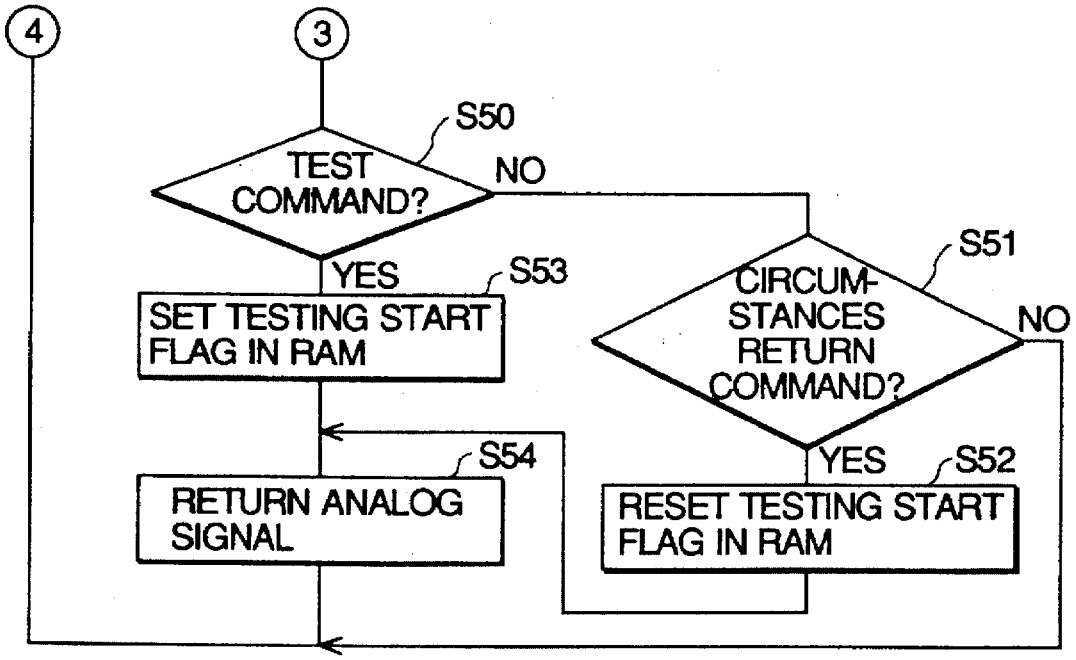
FIG. 9 is a flow chart illustrative of the operation of the fire detector shown in FIG. 1.

If a sensitivity adjustment command has not been given in step S32 (See FIG. 7) nor has a test adjustment command been given in step S34, in step S50 of FIG. 9, the smoke detector determines whether a test command has been given. In this case, since a test command (function test command) has been given, the flow proceeds to step S53. In step S53, since the test command has been transmitted from the fire receiver in step S73, the fire detector which has received the test command and which has the self address set to be 1, for example, the smoke detector 2, sets the testing start flag in the RAM 7. Then, in step S54 the fire detector 2 reads the analog signal A corresponding to the converted A/D value from a predetermined position of the RAM 7 and returns it to the fire receiver via the transmitting/receiving circuit 23.

In step S74 the fire receiver receives the analog signal transmitted from the fire detector 2. In step S75 the fire receiver determines whether the received analog signal used for testing is greater than a predetermined normal threshold Z. If the answer in S75 is YES, it is determined that the function of the fire detector 2 is normal, and in step S76 an indication of such a normal function of the smoke detector 2 is given. If the answer in S75 is NO, the flow proceeds to step S77 in which an indication of a faulty function of the smoke detector 2 is given. If the received analog signal is not used for testing, the contents of the fire determining processing similar to those shown in steps S66 and S67 of FIG. 11 are executed, though not shown.

After the above-mentioned indication is given, in step S78 the call address N is incremented by 1 and the resultant call address for a subsequent smoke detector is set.

In step S79 it is determined whether the call address N is the maximum NMAX. If the answer in S79 is NO, the flow returns to step S62 in which the foregoing procedure is repeated. That is, every time the fire receiver executes the foregoing fire detection for X times, the fire receiver performs function tests on the respective smoke detectors by sequentially transmitting test commands to a plurality of smoke detectors which are provided with respective different call addresses and are connected to the common line.

As will be clearly understood from the forgoing description, the present invention offers the following advantages.

According to this embodiment, an automatic adjustment can be made for the light emission value of a smoke detection light emitting diode. This eliminates the necessity of the following adjustment operations encountered by conventional apparatuses in the manufacturing process. Conventionally, it is necessary to change resistors for adjusting the voltage or the current of a light emitting circuit and to change resistors provided for amplifying circuits in order to avoid saturating an output from the amplifying circuit provided for a light receiving component. Further, it is also necessary to screen light emitting diodes used for a smoke detector. Such eliminations result in improvements in the yield, reductions in the number of manufacturing processes and the equipment investment costs, and also in preventing human adjustment errors.

Moreover, for the adjustment of a testing light emitting diode used for pseudo smoke, as well as for the smoke detection diode, the necessity of the following adjustment operations in the manufacturing process can be eliminated. More specifically, conventionally it is necessary to change resistors for adjusting the current or the voltage of a testing light emitting circuit so that an output from the amplifying circuit provided for a light receiving component becomes a predetermined value; and it is also necessary to change the resistors of the amplifying circuit in order to avoid saturating an output from the amplifying circuit. Further, it is necessary to screen light emitting diodes used for a smoke detector. Such eliminations result in improvements in the yield, reductions in the number of manufacturing processes and the equipment investment costs and also in preventing human adjustment errors.

Although in this embodiment a light scattering-type smoke detector has been described as a smoke detector, this is merely an illustration. Other types of smoke detectors, for example, a typical on/off-type smoke detector or a light obscuration-type smoke detector based on a different principle, may be applicable to the present invention, in which case, advantages similar to those obtained in this embodiment can be expected.

Moreover, in this embodiment a smoke test casing is used for adjusting the smoke detection light emitting device. However, in place of the smoke test casing, a light scattering strip, for example, may be inserted between a light emitting device and a light receiving device, and the equivalent smoke density of the light scattering strip may be used as the set smoke density S.

Additionally, the timer means may detect a normal time interval at which the light emitting device emits light during fire monitoring and a time interval shorter than the normal time interval. During the normal fire monitoring, the light emitting device may be permitted to emit light at the normal time interval, while it may be allowed to emit light at the shorter time interval when it receives a sensitivity adjustment command from the tester. This eliminates the necessity of the operator disturbing a circuit of the smoke detector while sensitivity adjustments of the smoke detector is under way, thus removing the danger of damaging devices within the circuit.

What is claimed is:

1. A smoke detector comprising light emitting means having at least a light emitting device used for a smoke detection and light receiving means for receiving a light output from said light emitting device, said smoke detector further comprising:

measurement means for measuring an output from said light receiving means;

signal generating means for generating a light emitting device drive signal for driving said light emitting device based on a value measured by said measurement means, said signal generating means including storage means for storing a value of the light emitting device drive signal;

adjustment means for adjusting a light emission quantity of said light emitting device based on an output from said signal generating means; and standard light emission value setting means for determining at an initializing stage whether a value for the light emitting device drive signal has been stored in said storage means and setting a standard light emission value in said storage means for said light emitting device drive signal when a value has not been stored in said storage means.

2. A smoke detector according to claim 1, wherein said measurement means comprises an A/D conversion circuit for converting the output from said light receiving means from an analog signal to a digital signal.

3. A smoke detector according to claim 1 or 2, wherein said signal generating means comprises: calculation means for processing the value measured by said measurement means through calculation and for storing the processing result in said storage means.

4. A smoke detector according to claim 1 or 2, wherein said signal generating means comprises: calculation means for processing the value measured by said measurement means through calculation and for storing the processing result in said storage means, and wherein said storage means is an electrically erasable and programmable non-volatile memory.

5. A smoke detector according to claim 1 or 2, wherein said signal generating means comprises: calculation means for processing the value measured by said measurement means through calculation and storing the processing result in said storage means, and wherein said light emitting device is provided with the standard light emission value set in said storage means at the initializing stage.

6. A smoke detector according to claim 1 or 2, wherein said storage means is an electrically erasable and programmable non-volatile memory, and wherein said light emitting device is provided with the standard light emission value set in said storage means at the initializing stage.

7. A fire detector according to claim 1 or 2, wherein said storage means is an electrically erasable and programmable non-volatile memory.

8. A smoke detector according to claim 1 or 2, wherein said adjustment means comprises: a D/A conversion circuit for converting the output from said signal generating means from a digital signal into a voltage signal; and a voltage/current conversion circuit for converting the voltage signal from said D/A conversion circuit into a light emitting current of said light emitting device.

9. A smoke detector according to claim 1 or 2, wherein said signal generating means comprises calculation means for processing the value measured by said measurement means through calculation and storing the processing result in said storage means, and wherein said adjustment means a D/A conversion circuit for converting the output from said signal generating means from a digital signal into a voltage signal, and a voltage/current conversion circuit for converting the voltage signal from said D/A conversion circuit into a light emitting current of said light emitting device.

10. A smoke detector according to claim 1 or 2, wherein said signal generating means comprises calculation means for processing the value measured by said measurement means through calculation and storing a processing result in said storage means, wherein said storage means is an electrically erasable and programmable non-volatile memory, and wherein said adjustment means comprises a D/A conversion circuit for converting the output from said signal generating means from a digital signal into a voltage signal, and a voltage/current conversion circuit for converting the voltage signal from said D/A conversion circuit into a light emitting current of said light emitting device.

11. A smoke detector comprising light emitting means having light emitting devices used for a smoke detection and testing, and light receiving means for selectively receiving a light output from each of said light emitting devices, said smoke detector further comprising:

measurement means for selectively measuring an output from said light receiving means provided for each of said light emitting devices;

signal generating means for generating a light emitting device drive signal for driving each of said light emitting devices based on a value measured by said measurement means corresponding to each of said light emitting devices, said signal generating means including storage means for storing a value of the light emitting device drive signal;

adjustment means for adjusting a light emission quantity of each of said light emitting devices based on an output from said signal generating means; and standard light emission value setting means for determining at an initializing stage whether a value for the light emitting device drive signal has been stored in said storage means and setting a standard light emission value in said storage means for said light emitting device drive signal when a value has not been stored in said storage means.

12. A smoke detector according to claim 11, wherein said measurement means comprises an A/D conversion circuit for converting the output from said light receiving means from an analog signal to a digital signal.

13. A smoke detector according to claim 11 or 12, wherein said signal generating means comprises: calculation means for processing the value measured by said measurement means through calculation and for storing the processing result in said storage means.

14. A smoke detector according to claim 11 or 12, wherein said signal generating means comprises calculation means for processing the value measured by said measurement means through calculation and storing a processing result in said storage means and wherein said storage means is an electrically erasable and programmable non-volatile memory.

15. A smoke detector according to claim 11 or 12, wherein said signal generating means comprises calculation means for processing the value measured by said measurement means through calculation and storing a processing result in said storage means, and wherein each of said light emitting devices is provided with a standard light emission value set in said storage means at the initialization stage.

16. A smoke detector according to claim 11 or 12, wherein said storage means is an electrically erasable and programmable non-volatile memory, and wherein each of said light emitting devices is provided with a standard light emission value set in said storage means at the initialization stage.

17. A smoke detector according to claim 11 or 12, wherein said storage means is an electrically erasable and programmable non-volatile memory.

18. A smoke detector according to claim 11 or 12, wherein said adjustment means comprises: a D/A conversion circuit for converting the output from said signal generating means from a digital signal to a voltage signal; and a voltage/current conversion circuit for converting the voltage signal from said D/A conversion circuit to a light emission current of said light emitting device.

19. A smoke detector according to claim 11 or 12, wherein said signal generating means comprises calculation means for processing the value measured by said measurement means through calculation and storing a processing result in said storage means, and wherein said adjustment means comprises a D/A conversion circuit for converting the output from said signal generating means from a digital signal to a voltage signal, and a voltage/current conversion circuit for converting the voltage signal from said D/A conversion circuit to a light emission.

20. A smoke detector according to claim 11 or 12, wherein said signal generating means comprises calculation means for processing the value measured by said measuring means through calculation and storing a processing result in said storage means, wherein said storage means is an electrically erasable and programmable non-volatile memory, and wherein said adjustment means comprises a D/A conversion circuit for converting the output from said signal generating means from a digital signal to a voltage signal, and a voltage/current conversion circuit for converting the voltage signal from said D/A conversion circuit to a light emission current of said light emitting device.

21. A smoke detector comprising light emitting means having at least a light emitting device used for testing and light receiving means for receiving a light output from said light emitting device, said smoke detector further comprising:

measurement means for measuring an output from said light receiving means;

signal generating means for generating a light emitting device drive signal for driving said light emitting device based on a value measured by said measurement means, said signal generating means including storage means for storing a value of the light emitting device drive signal;

adjustment means for adjusting a light emission quantity of said light emitting device based on an output from said signal generating means; and standard light emission value setting means for determining at an initializing stage whether a value for the light emitting device drive signal has been stored in said storage means and setting a standard light emission value in said storage means for said light emitting device drive signal when a value has not been stored in said storage means.

22. A smoke detector according to claim 21, wherein said measurement means comprises an A/D conversion circuit for converting the output from said light receiving means from an analog signal to a digital signal.

23. A smoke detector according to claim 21 or 22, wherein said signal generating means comprises: calculation means for processing the value measured by said measurement means through calculation and for storing the processing result in said storage means.

24. A smoke detector according to claim 21 or 22, wherein said signal generating means comprises: calculation means for processing the value measured by said measurement means through calculation and for storing the processing result in said storage means, and wherein said storage means is an electrically erasable and programmable non-volatile memory.

25. A smoke detector according to claim 21 or 22, wherein storage means is an electrically erasable and programmable non-volatile memory.

26. A smoke detector according to claim 21 or 22, wherein said adjustment means comprises: a D/A conversion circuit for converting the output from said signal generating means from a digital signal to a voltage signal; and a voltage/current conversion circuit for converting the voltage signal from said D/A conversion circuit to a light emission current of said light emitting device.

27. A smoke detector according to claim 21 or 22, wherein said signal generating means comprises calculation means for processing the value measured by said measurement means through calculation and storing a processing result in said storage means, and wherein said adjustment means comprises a D/A conversion circuit for converting the output from said signal generating means from a digital signal to a voltage signal, and a voltage/current conversion circuit for converting the voltage signal from said D/A conversion circuit to a light emission current of said light emitting device.

28. A smoke detector according to claim 21 or 22, wherein said signal generating means comprises calculation means for processing the value measured by said measurement means through calculation and storing a processing result in said storage means, wherein said storage means is an electrically erasable and programmable non-volatile memory, and wherein said adjustment means comprises a D/A conversion circuit for converting the output from said signal generating means from a digital signal to a voltage signal, and a voltage/current conversion circuit for converting the voltage signal from said D/A conversion circuit to a light emission current of said light emitting device.

* * * * *

UNITED STATES PATENT AND TRADEMARK OFFICE

CERTIFICATE OF CORRECTION

PATENT NO. : 5,673,027

DATED : September 30, 1997

INVENTOR(S) : Toshikazu MORITA

It is certified that error appears in the above-identified patent and that said Letters Patent is hereby corrected as shown below:

In the drawings, Sheet 7, Fig. 8, the text "return ACK Signal" should be deleted from under the flow lines that flow from blocks S41 and S49.

Figure 11:
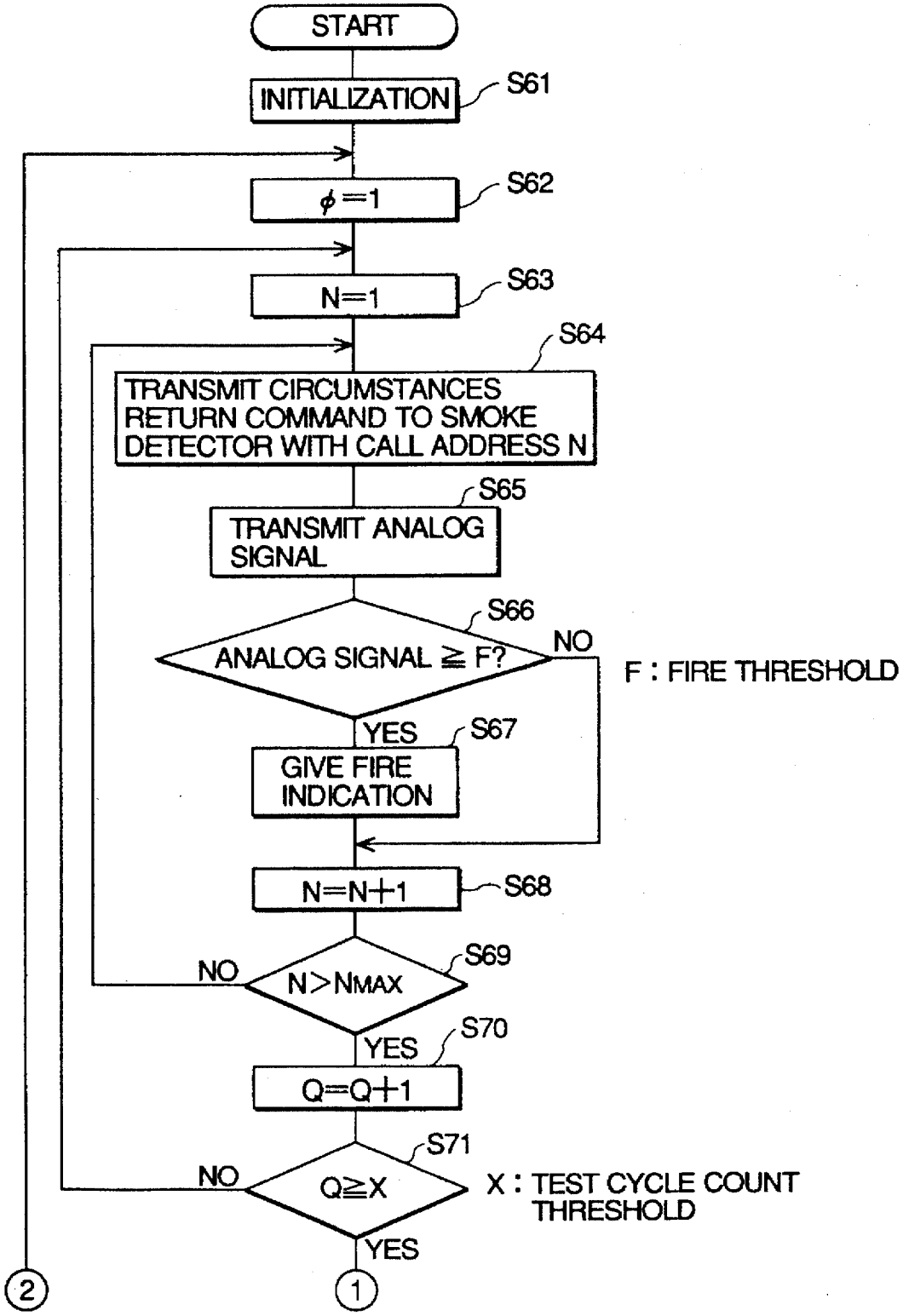
FIG. 11 is a flow chart illustrative of the operation of a fire receiver connected to the fire detector according to the present invention.

In the drawings, Sheet 10, Fig. 11, in block S62 "$\phi$" should be deleted and replaced with --Q--, and in block S65 "transmit" should be deleted and replaced with --receive--.

In Column 14, line 6, "Fig. 11" should read --Fig. 12--.

In Claim 7, line 1, column 16, line 34, "fire detector" should read --smoke detector--.

In Claim 9, line 5, column 16, line 48, --comprises-- should be inserted after "adjustment means".

UNITED STATES PATENT AND TRADEMARK OFFICE

CERTIFICATE OF CORRECTION

PATENT NO. : 5,673,027

DATED : September 30, 1997

INVENTOR(S) : Toshikazu MORITA

It is certified that error appears in the above-identified patent and that said Letters Patent is hereby corrected as shown below:

In Claim 25, line 2, column 18, line 57, --said-- should be inserted before "storage means".

Signed and Sealed this

Tenth Day of March, 1998

*Attest:*

*Attesting Officer*

BRUCE LEHMAN

*Commissioner of Patents and Trademarks*